US009119477B1

(12) United States Patent
LeRoy et al.

(10) Patent No.: US 9,119,477 B1
(45) Date of Patent: Sep. 1, 2015

(54) SEAT PAD TIE DOWN APPARATUS AND METHOD OF USING SAME

(71) Applicant: Peak Season, Inc., Irondale, AL (US)

(72) Inventors: Timothy M. LeRoy, Mountain Brook, AL (US); Julie Bryant Bush, Mountain Brook, AL (US); Patsy Ruth Taylor, Trussville, AL (US)

(73) Assignee: Peak Season, Inc., Irondale, AL (US)

( * ) Notice: Subject to any disclaimer, the term of this patent is extended or adjusted under 35 U.S.C. 154(b) by 0 days.

(21) Appl. No.: 13/683,388

(22) Filed: Nov. 21, 2012

(51) Int. Cl.
*A47C 20/02* (2006.01)
*A47C 7/02* (2006.01)

(52) U.S. Cl.
CPC ..... *A47C 20/02* (2013.01); *A47C 7/021* (2013.01); *A47C 7/022* (2013.01); *A47C 7/02* (2013.01)

(58) Field of Classification Search
CPC ..... A47C 7/02–7/024; A47C 20/02
USPC ..... 5/657, 653, 656
See application file for complete search history.

(56) References Cited

U.S. PATENT DOCUMENTS

| | | | | |
|---|---|---|---|---|
| 2,205,302 | A | 6/1940 | Morgenstern | |
| 2,782,839 | A | 2/1957 | Cole | |
| 4,568,125 | A | 2/1986 | Sckolnik | |
| 4,827,876 | A | 5/1989 | Krekelberg | |
| 5,509,718 | A | 4/1996 | Neary | |
| 6,175,980 | B1 | 1/2001 | Gaither | |
| 7,261,375 | B2 | 8/2007 | Godshaw et al. | |
| 7,481,491 | B1 | 1/2009 | Diamantis | |
| 7,770,248 | B2 * | 8/2010 | Furlow | 5/722 |
| 2006/0253989 | A1 * | 11/2006 | Robinson | 5/657 |
| 2007/0271704 | A1 * | 11/2007 | Breeland | 5/653 |
| 2010/0269261 | A1 * | 10/2010 | Furlow | 5/653 |
| 2013/0341978 | A1 * | 12/2013 | Perez | 297/219.1 |

FOREIGN PATENT DOCUMENTS

DE 3934779 A1 * 4/1991

OTHER PUBLICATIONS

Flickety http://www.wikihow.com/Fix-Kitchen-Chair-Cushion-Ties Apr. 30, 2008.*

* cited by examiner

*Primary Examiner* — Peter M Cuomo
*Assistant Examiner* — Brittany Wilson
(74) *Attorney, Agent, or Firm* — C. Brandon Browning; Maynard Cooper & Gale

(57) ABSTRACT

A seat tie apparatus and method of using same, the apparatus including a cushion material contained within an enclosure. A first strap is connected at each end thereof to the enclosure and extends across a first back corner of the enclosure. A second strap, spaced apart from the first strap, is connected at each end thereof to the enclosure and extends across a second back corner of the enclosure. First and second ties are slidably coupled to the first and second straps, respectively. Each of the first and second ties is constructed of at fabric strip coupled to itself about a central portion thereof to form a loop. The straps are arranged to extend through the loops and allow the ties to slide there along.

6 Claims, 3 Drawing Sheets

SEAT PAD TIE DOWN APPARATUS AND METHOD OF USING SAME

FIELD OF THE INVENTION

The present invention relates to a seat pad tie down apparatus and more particularly to an adjustable seat pad tie down apparatus and method of using same.

BACKGROUND OF THE INVENTION

Seat pad tie down devices are known in the art. For example, U.S. Pat. No. 7,481,491 discloses a reversible chair pad including a cover having first and second fabrics forming respective first and second surfaces of the pad that are mutually attached at the pad perimeter, and where the first and second fabrics also form a two-ply skirt member extending from the pad perimeter. The pad also includes a first set of securing ties for securing the pad to chair spindles when the pad is configured to display the first fabric attached to an edge of the pad perimeter intermediate the skirt member and the first surface. Also included is a second set of securing ties for securing the pad to chair spindles when the pad is configured to display the second fabric, the second set of ties attached intermediate the skirt member and the second surface to the same edge of the pad perimeter as that to which the first set of ties is attached.

U.S. Pat. No. 6,175,980 discloses a seat cushion including a cushion cover with a visco-elastic, liquid-solid pad sandwiched between a pair of closed cell foam pads. The pads are received inside the cushion cover. The seat cushion also includes rear straps with hook fasteners and loop fasteners mounted on the ends of the straps. The hook fasteners and loop fasteners are used for securing the cushion to the back of a seat. Also the cushion includes front straps having hook fasteners mounted on ends the front straps. The front straps are used for securing the cushion to bottom of the front of a seat.

SUMMARY OF THE INVENTION

The present invention is directed to a seat pad and method of using same. The seat pad includes a pair of adjustable connector portions that allow the seat pad to be coupled to chairs of different sizes and configurations. This is accomplished by slidably attaching ties, which are provided for tying the seat pad to a chair's spindles or legs, to straps which extend substantially horizontally and partially around a perimeter of a back portion of the seat pad. The slidable coupling of the ties to the straps allows the distance between the ties to be adjusted to align with the placement of the chairs spindles or legs. In this manner, the seat pad can be temporarily coupled to a first chair having attachments points that are a first distance apart and later coupled to a second chair having attachments points that are closer or father apart than the attachment points of the first chair.

According to one aspect of the invention, there is provided a seat pad including a cushion material contained within an enclosure. A first strap is connected at each end thereof to the enclosure. A second strap, spaced apart from the first strap, is also connected at each end thereof to the enclosure. Preferably, the first strap extends across a first back corner of the enclosure and the second strap extends across a second back corner of the enclosure. However, it is contemplated that in certain applications, the first and second straps may extend across opposing front corners of a seat pad. Further, the first and second straps may be directly coupled to a seam formed between a top portion and a bottom portion of the enclosure. First and second ties are slidably coupled to the first and second straps, respectively. Each of the first and second ties is constructed of at fabric strip coupled to itself about a central portion thereof to form a loop. The straps are arranged to extend through the loops and allow the ties to slide there along.

According to another aspect of the invention, there is provided an adjustable seat pad connector for connecting a seat pad to a chair. The seat pad connector includes a first strap connected to the seat pad, a second strap connected to the seat pad, a first tie slidably coupled to the first strap, and a second tie slidably coupled to the second strap. The first strap is coupled directly to a first lateral side of the enclosure and a back side of the enclosure, and the second strap is coupled directly a second lateral side of the enclosure and the backside of the enclosure. The first tie includes a first flexible strip coupled to itself about a central portion thereof to form a first loop, the first strap extending through the first loop. Likewise, the second tie includes a second flexible strip coupled to itself about a central portion thereof to form a second loop, the second strap extending through the second loop.

According to yet another aspect of the invention, there is provided an adjustable seat pad connector including a first strap having first end portions coupled directly to a seat pad and a first midsection portion spaced apart from the seat pad, the first midsection portion extending from a first lateral side of the seat pad to a back side of the seat pad, and a second strap having second end portions coupled directly to the seat pad and a second midsection portion spaced apart from the seat pad, the second midsection portion extending from a second lateral side of the seat pad to the back side of the seat pad. A first tie is slidably coupled to the first midsection portion, the first tie having a first loop through which the first midsection portion extends. A second tie is slidably coupled to the second midsection portion, the second tie having a second loop through which the second midsection portion extends.

In use, a seat pad including the adjustable seat pad connector is placed on a chair with the first midsection portion located adjacent to a first vertically arranged chair member and the second midsection portion is located adjacent to a second vertically arranged chair member. The distance between the first loop and the second loop is then adjusted to align the first and second ties with the vertically arranged chair members by sliding the first loop along the first midsection portion of the first strap and the second loop along the second midsection portion of the second strap. Once aligned with their respective vertically arranged chair members, the first tie is tied to the first vertically arranged chair member and the second tie is tied to the second vertically arranged chair member.

DETAILED DESCRIPTION OF PRESENTLY PREFERRED EMBODIMENTS

Figure 1:
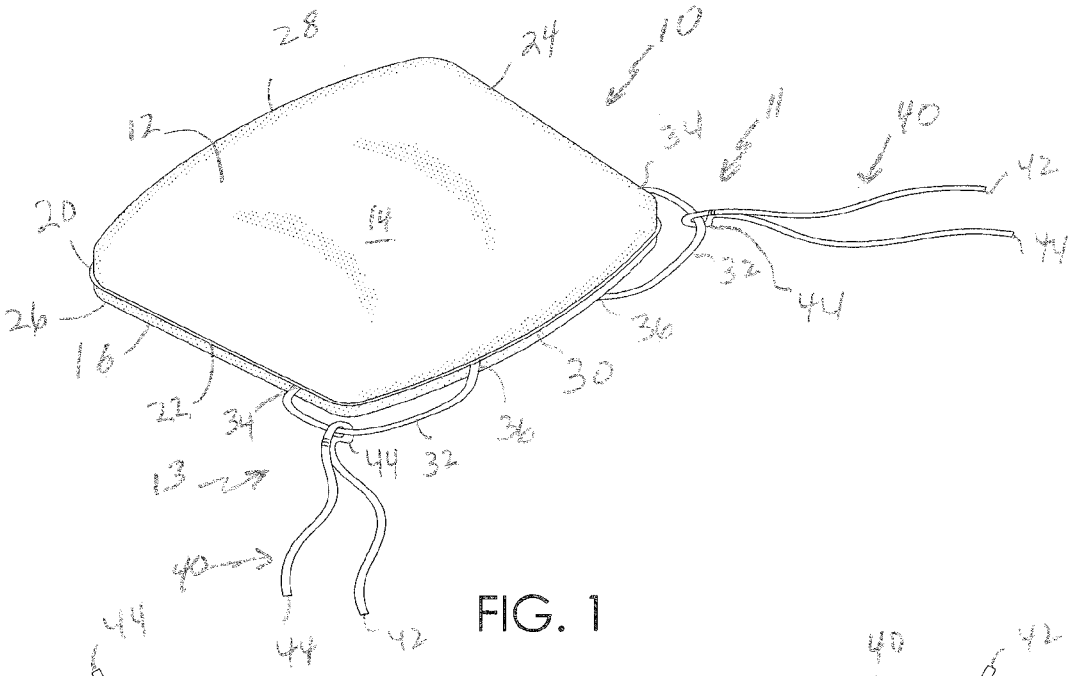
FIG. 1 is perspective view of a backside of a seat pad in accordance with a preferred embodiment of the present invention.
Figure 2:
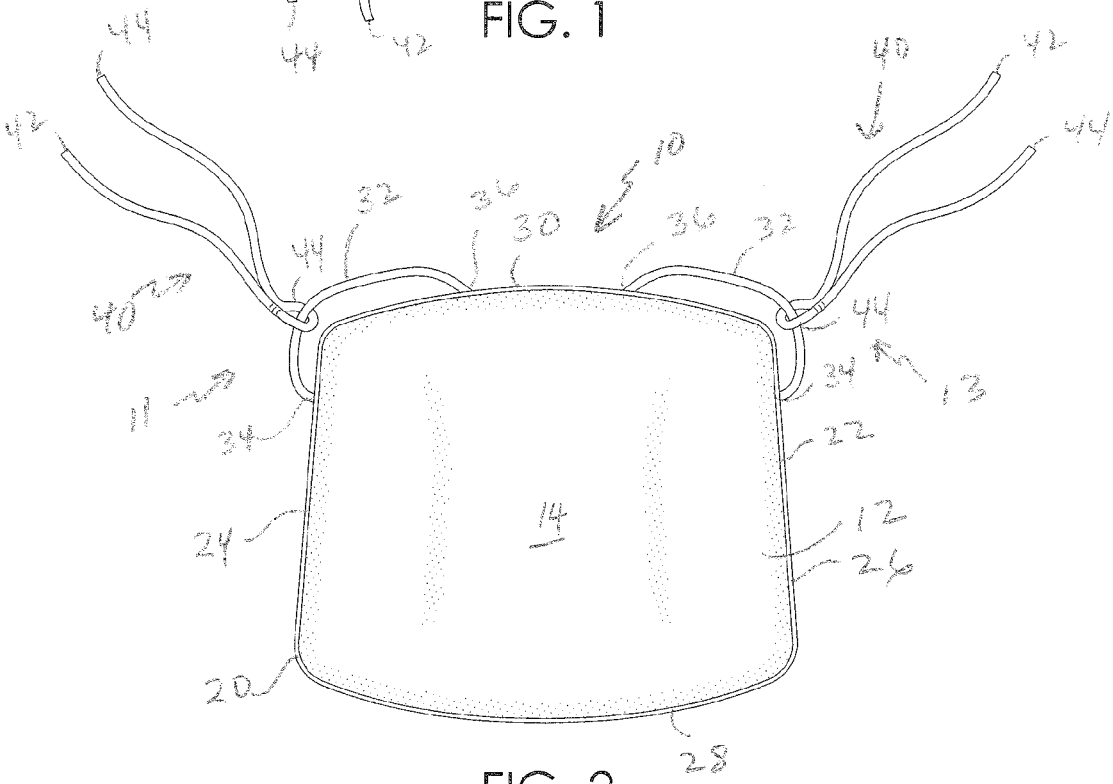
FIG. 2 is a top plan view of the seat pad of FIG. 1.
Figure 3:
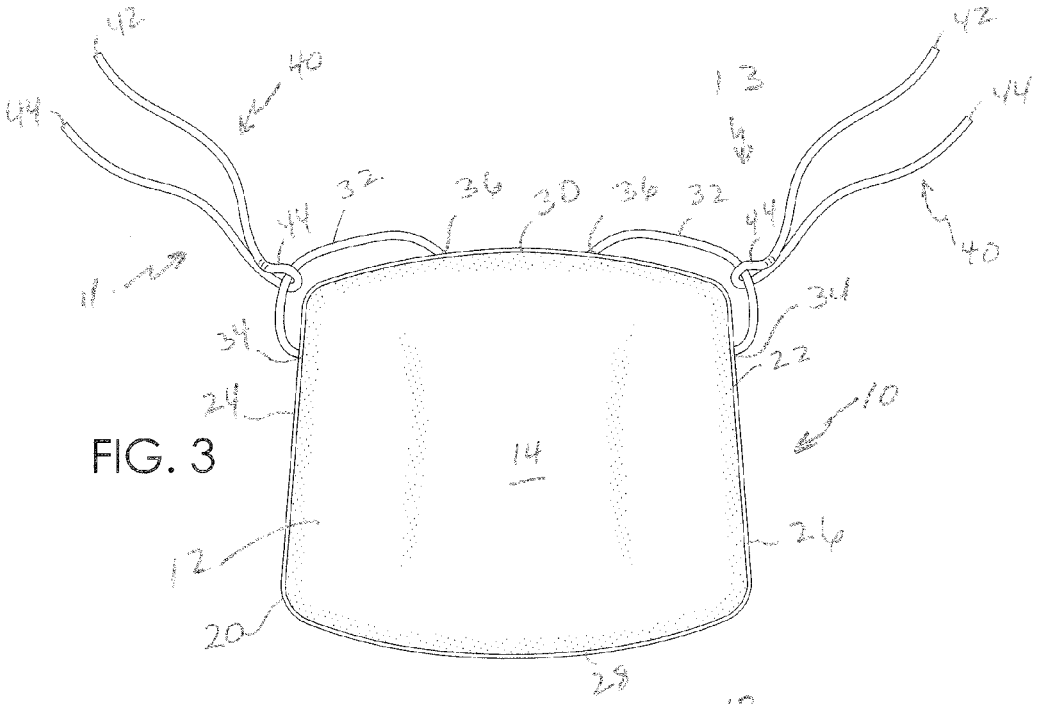
FIG. 3 is a bottom plan view of the seat pad of FIG. 1.
Figure 4:
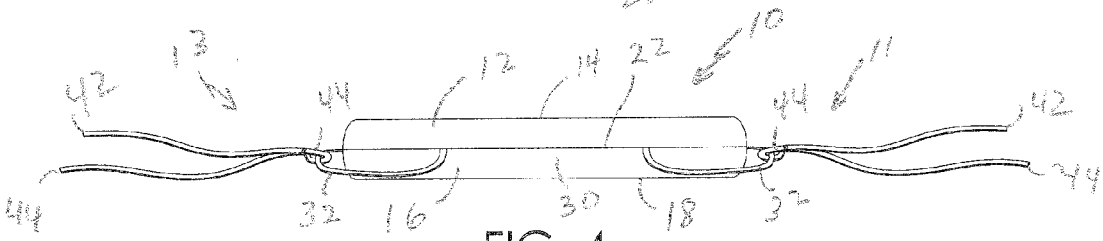
FIG. 4 is an elevational view of a back side of the seat pad of FIG. 1.
Figure 5:
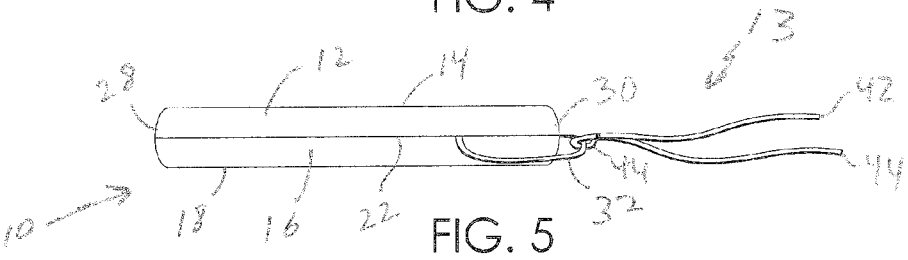
FIG. 5 is an elevational view of a lateral side of the seat pad of FIG. 1.
Figure 6:
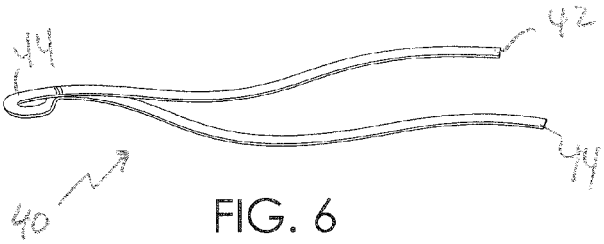
FIG. 6 is a perspective view of a tie of the seat pad of FIG. 1

FIGS. 1 through 7 illustrate a seat pad 10 in accordance with a preferred embodiment of the present invention. Seat pad 10 includes adjustable connector portions 11, 13 that are adapted and arranged to allow seat pad 10 to be tied to chairs of different sizes and configurations. The elements of the drawings are not necessarily to scale, emphasis instead being placed upon clearly illustrating the principles of the invention. Throughout the drawings, like numerals are used for like and corresponding parts of the various drawings. It should be noted that in the drawings, the dotted lines represent seams created by stitching.

More particularly, seat pad 10 includes a pillow member which is covered in a first fabric 12 forming a first surface 14. Likewise the opposing side of the pillow member is covered in a second fabric 16 forming a second surface 18. First and second fabrics 12, 16 are stitched together at a pad perimeter 20 to form a perimeter seam 22. The resulting seat pad 10, includes opposing lateral sides 24, 26, a front side 28 and a back side 30. The pillow member may be a unitary member formed from any suitable material known in the art, a non-limiting example of which is polymeric foam. The pillow member may alternatively be a casing filled with suitable loose-fill, fibrous or feather material.

Stitched into perimeter seam 22 are first and second adjustable connector portions 11, 13. Each of adjustable connector portions 11, 13 includes a single piece of elongate fabric 32 having ends 34, 36 that are stitched into seat pad 10 at predetermined points along perimeter seam 22. Specifically, elongate fabric piece 32 of first connector portion 11 is coupled at end 34 to perimeter seam 22 on lateral side 24 of seat pad 10 and at end 36 to perimeter seam 22 on back side 30 of seat pad 10. So arranged, elongate fabric piece 32 of first connector portion 11 extends substantially horizontally and partially around a back portion of pad perimeter 20 and across a first back corner 38 of seat pad 10. Similarly, elongate fabric piece 32 of second connector portion 13 is coupled at end 34 to perimeter seam 22 on lateral side 26 of seat pad 10 and at end 36 to perimeter seam 22 on back side 30 of seat pad 10. So arranged, elongate fabric piece 32 of second connector portion 13 extends substantially horizontally and partially around a back portion of pad perimeter 20 and across a second back corner 38 of seat pad 10. Preferably, the attachment locations of elongate fabric pieces 32 are aligned horizontally along perimeter seam 22 and are arranged to be co-planar.

Each of adjustable connector portions 11, 13 further includes a tie 40 slidably coupled thereto. In particular, each tie 40 is provided as a fabric strip having two free ends 42, 44. A central portion of each tie is stitched to itself thereby forming a loop 44 at the central portion thereof. Each of ties 40 is slidably coupled to a respective elongate fabric piece 32 of first and second connector portions 11, 13 by arranging elongate fabric pieces 32 to extend through loops 44. In this manner, loops 44 of ties 40 can be easily moved along respective elongate fabric pieces 32 between ends 34, 36 thereof.

Figure 7:
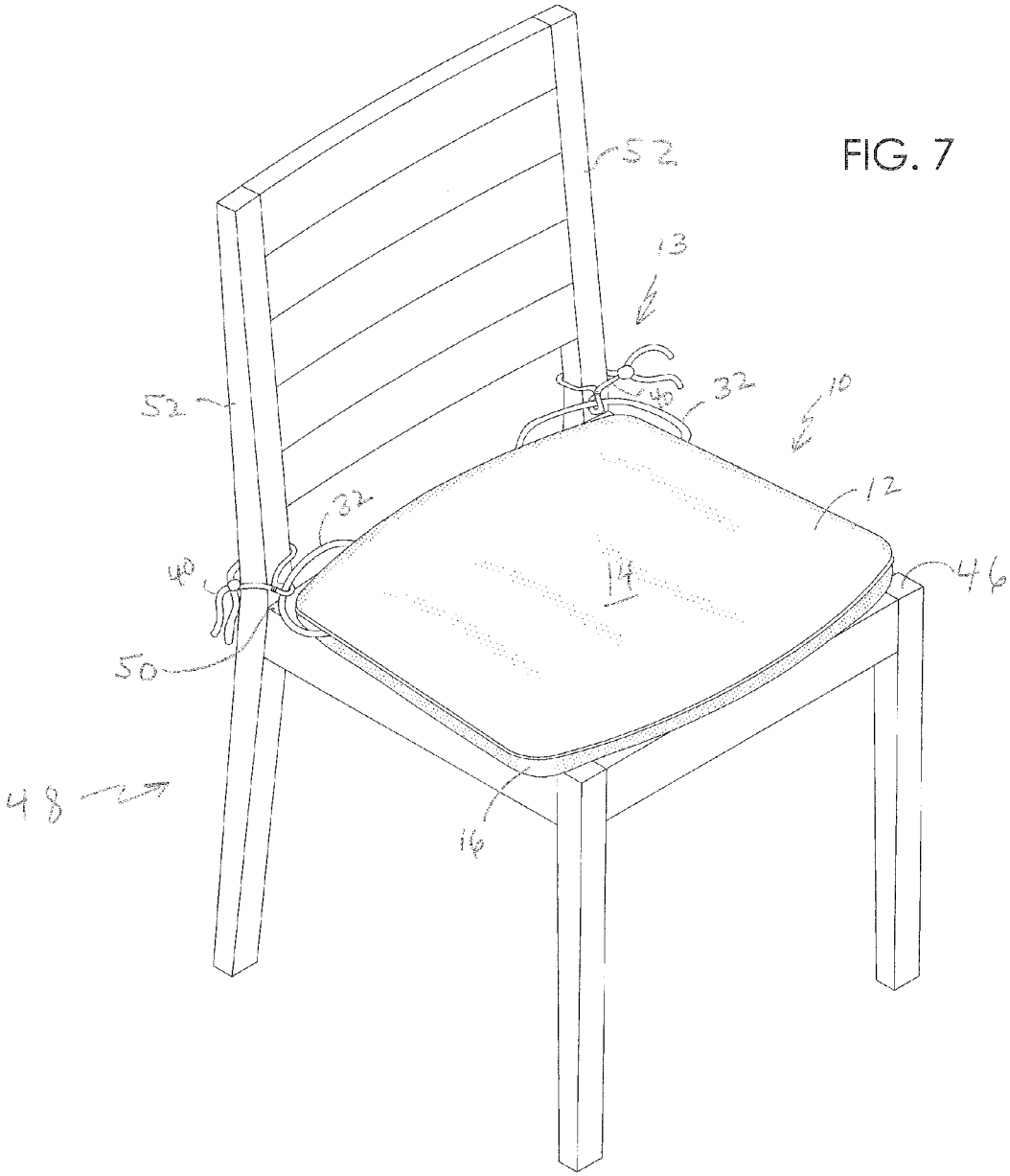
FIG. 7 is a perspective view of the seat pad of FIG. 1 coupled to a chair.

Referring to FIG. 7, when in use, seat pad 10 is placed on a seat 46 of a chair 48 with back side 30 of seat pad 10 arranged adjacent to a back 50 of chair 50 and a second surface 18 of seat pad 10 resting directly upon chair seat 46. In FIG. 7, back 50 of chair 48 is shown to include a pair of spindles 52 which extend vertically upwards from chair seat 46. When seat pad 10 is placed on chair seat 46, as previously described, first connector portion 11 is arranged adjacent to a first spindle 52 and second connector portion 13 is arranged adjacent to a second spindle 52. Depending the distance between first and second spindles 52, ties 40 are slid along their respective elongate fabric piece 32, so that their respective loops 44 are aligned with the adjacent outer spindle. Once aligned, ties 40 are tied to spindles 52.

As will be apparent to one skilled in the art, various modifications can be made within the scope of the aforesaid description. Such modifications being within the ability of one skilled in the art form a part of the present invention and are embraced by the claims below.

It is claimed:

1. A seat pad comprising:

a cushion material contained within an enclosure, a first strap connected at each end thereof to the enclosure, the first strap being provided as a first single, indivisible piece, a second strap spaced apart from the first strap and connected at each end thereof to the enclosure, the strap being provided as a second single, indivisible piece, a first tie slidably coupled to the first strap, and a second tie slidably coupled to the second strap, wherein the first strap is coupled directly to a first lateral side of the enclosure and a back side of the enclosure and the second strap is coupled directly a second lateral side of the enclosure and the back side of the enclosure and the first strap extends across a first corner of the enclosure and the second strap extends across a second corner of the enclosure, and wherein the first tie includes a first fabric strip coupled to itself about a central portion thereof to form a first loop, the first strap extending through the first loop and the second tie includes a second fabric strip coupled to itself about a central portion thereof to form a second loop, the second strap extending through the second loop.

2. The seat pad according to claim 1 wherein each of the first tie and the second tie includes at least two free ends.

3. The seat pad according to claim 1 wherein, when the seat pad is placed on a chair in an operative position, the first strap and the second strap extend substantially horizontally.

4. The seat pad according to claim 1 wherein the first tie has a first length and the second tie has a second length, the first length and the second length each being greater than that of a length of the first strap.

5. The seat pad according to claim 1 wherein the first strap and the second strap are directly coupled to a seam formed between a top portion and a bottom portion of the enclosure.

6. A method of attaching the seat pad of claim 1 to a chair comprising placing the seat pad on a horizontal surface of the chair with the first strap located adjacent to a first vertically arranged chair member and the second strap located adjacent to a second vertically arranged chair member, sliding the first tie along the first strap, sliding the second tie along the second strap, tying the first tie to the first vertically arranged chair member and tying the second tie to the second vertically arranged chair member.

* * * * *